US008657393B2

(12) United States Patent
Tsumoto

(10) Patent No.: US 8,657,393 B2
(45) Date of Patent: Feb. 25, 2014

(54) INK JET PRINTING APPARATUS AND METHOD OF CONTROLLING INK JET PRINTING APPARATUS

(75) Inventor: Manabu Tsumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 754 days.

(21) Appl. No.: 12/262,919

(22) Filed: Oct. 31, 2008

(65) Prior Publication Data

US 2009/0122094 A1 May 14, 2009

(30) Foreign Application Priority Data

Nov. 13, 2007 (JP) ..... 2007-294390
Oct. 2, 2008 (JP) ..... 2008-257507

(51) Int. Cl.
*B41J 29/38* (2006.01)

(52) U.S. Cl.
USPC ..... 347/5

(58) Field of Classification Search
USPC ..... 347/5
See application file for complete search history.

(56) References Cited

U.S. PATENT DOCUMENTS

| | | | | |
|---|---|---|---|---|
| 5,555,006 | A * | 9/1996 | Cleveland et al. | 347/41 |
| 6,565,171 | B2 * | 5/2003 | Miquel et al. | 347/5 |
| 6,604,820 | B1 * | 8/2003 | Fukuda | 347/104 |
| 2004/0090486 | A1 * | 5/2004 | Shimoyama | 347/34 |

FOREIGN PATENT DOCUMENTS

| | | |
|---|---|---|
| JP | 2002-96511 | 4/2002 |
| JP | 2006-168187 | 6/2006 |

* cited by examiner

*Primary Examiner* — Uyen Chau N Le
*Assistant Examiner* — Hoang Tran
(74) *Attorney, Agent, or Firm* — Fitzpatrick, Cella, Harper & Scinto

(57) ABSTRACT

The present invention provides an ink jet printing apparatus that inhibits possible density unevenness in an image even though the apparatus performs printing by driving a fan mounted therein. The ink jet printing apparatus according to the present invention includes a print head having an ejection port through which ink is ejected and scanning a print medium in a direction orthogonal to a direction in which the print medium is conveyed, while ejecting droplets to the print medium for printing. A fan performing rotational driving is mounted in the ink jet printing apparatus. The fan is driven so as to vary the number of revolutions thereof for every predetermined amount of scan performed by the print head.

9 Claims, 10 Drawing Sheets

INK JET PRINTING APPARATUS AND METHOD OF CONTROLLING INK JET PRINTING APPARATUS

BACKGROUND OF THE INVENTION

1. Field of the Invention

The present invention relates to an ink jet printing apparatus that ejects droplets to print a print medium, and a method of controlling the ink jet printing apparatus.

2. Description of the Related Art

Some ink jet printing apparatuses are of a serial scan type in which printing is performed by a carriage, with a print head mounted thereon, which reciprocates in a direction orthogonal to a print medium conveying direction scanning, while ejecting droplets. In addition to the serial scan type, ink jet printing apparatuses of a full line type are available in which printing is performed by an elongated print head extending over the entire area of the print medium in a width direction thereof and ejecting droplets without scanning. In these ink jet printing apparatuses, the print head and the print medium are spaced from each other, and droplets ejected from the print head cross through the space between the print head and the print medium before impacting the print medium. The ink jet printing apparatuses thus perform printing. The ink jet printing apparatus is generally very quiet, inexpensive to operate, and facilitates size reduction of the apparatus as well as permitting multicolor printing. The ink jet printing apparatus has been widely adopted for printers, copiers, facsimile machines, and the like. Print media onto which droplets are ejected are usually paper media or thin resin sheets (OHP sheets or the like). Furthermore, in recent years, there have been demands for a variety of material as print media. Besides the ordinary print sheets such as paper and thin resin sheets, clothing, leather, and metal have been used for commercial printing apparatuses.

As print media other than paper for printing, thinner print media, for example, thin resin-like print films may be used for the ink jet printing apparatus. In this case, the use of thin print media for printing may result in formation of wrinkles on the print media during conveyance due to the softness of the print media (the lack of elasticity). Furthermore, if roll paper or the like is used for printing, the print media may tend to be bent particularly when the print media are thick and hard. If the print medium with a non-flat print surface is printed using the ink jet printing apparatus, when the print medium is conveyed to a position corresponding to the print head, the print head and the print medium may come into contact with each other. Then, ink attached to the periphery of ejection ports may adhere to the print medium and stain the print medium, or the contact with the print medium may cause the print head to break down. Moreover, the distance between the print head and the print medium may vary, when not in constant. Thus, a position where ink impacts the print medium during printing may deviate from the correct position. This may degrade the quality of images obtained by printing.

A configuration disclosed in Japanese Patent Laid-Open No. 2002-096511 is known as an ink jet printing apparatus that prevents a non-flat print medium from being conveyed to a position corresponding to the print head. In this printing apparatus, a suction port is formed on a holding surface of a conveyance path on which the print medium is held, to suck and hold the print medium. The suction port is connected to a suction fan via a duct. The suction fan is drivingly controlled to suck the print medium onto the holding surface of the conveyance path under a given negative pressure. Consequently, the print medium which wrinkles or tends to be bent is held against the holding surface of the conveyance path of the inkjet printing apparatus. The print medium is thus conveyed in a correct parallel manner. The negative pressure applied to the print media flattens the surface of the print medium to fix the distance between the print head and the print medium. Droplets are thus accurately ejected to predetermined positions on the print medium. As a result, the quality of print images is improved.

When droplets are ejected from an ink jet printing apparatus, droplets (hereinafter referred to as satellites) different from main droplets intended for printing may be generated. Moreover, the satellites may be suspended in the space between the print head and the print medium without coming into contact with the print medium or droplets ejected onto the print medium bounce from the print medium, or the like, to generate fine droplets (hereinafter referred to as mist or ink mist). When the satellites or mist, which is different from the main droplets, is generated simultaneously with generation of the main droplets during printing, the satellites adhere to the print medium to degrade image quality. Furthermore, the mist generated may adhere to a carriage guide shaft or an optical sensor inside the ink jet printing apparatus, which is likely to be corroded to degrade the durability of the ink jet printing apparatus. Thus, droplets other than the main droplets, which are suspended between the print head and the print medium, need to be moved to an area which does not pose a problem or to be collected.

An ink jet printing apparatus including a suction fan to move or collect the ink mist is disclosed in Japanese Patent Laid-Open No. 2006-168187. The suction fan provided in the ink jet printing apparatus generates a given air stream inside the ink jet printing apparatus to move or collect the ink mist. Specifically, Japanese Patent Laid-Open No. 2006-168187 discloses an ink jet printing apparatus provided with a suction fan on the carriage with the print head mounted thereon. The wind speed and air quantity is increased or decreased depending on the number of scans for printing.

The ink jet printing apparatus is drivingly controlled so as to provide a suction pressure and air quantity which satisfy conditions such as temperature and humidity of the printing apparatus and a conveyance length over which the print medium is conveyed as the configuration in which the fan is attached to the ink jet printing apparatus. The fan is generally controlled so as to maintain a given number of revolutions under the above-described conditions.

However, in the ink jet printing apparatus with the fan attached thereto, when the fan is driven, a vibration may be created by the unbalance between blade portions, a variation in motor torque required to rotate the fan, or the like. The vibration occurs as a vibration frequency corresponding to the number of revolutions of the fan.

FIG. 9 shows an example of the waveform of a possible vibration when the fan is driven. The fan is driven at a constant number of revolutions, and a vibration of the frequency corresponding to the number of revolutions occurs in the fan. The vibration caused by the driving of the fan is transmitted via a chassis or main body outer cover of the ink jet printing apparatus to the print head on the carriage or a platen surface on which the print medium is placed for printing. The amplitude and phase of the vibration caused by the driving of the fan in the print head generally differs from those in the platen surface owing to the difference between the transmission path to the print head, located on the carriage, and the transmission path to the platen surface. Therefore, the vibration caused by the driving of the fan may vary the distance between the ejection port and the print medium.

For the print heads in the currently available ink jet printing apparatuses, the density of ejection ports inside the print head is increased to provide high-definition images to be printed. As described above, print heads of a type in which a plurality of ejection ports are formed in one print head are commonly used. However, if a print head with a plurality of ejection ports formed in a main scanning direction is used for printing, the distance between the ejection port and the print medium during ejection of droplets varies among the ejection ports. With reference to FIG. 10, a description will be given of the track of the ejection ports observed when the print head having a plurality of ejection ports formed in the main scanning direction is viewed along the main scanning direction.

FIG. 10 is an enlarged diagram schematically showing the periphery of the print head in order to describe the distance between the ejection port and the print medium observed when droplets are ejected. A print head 501 shown in FIG. 10 is mounted on a carriage 500 and has a plurality of ejection ports arranged in the main scanning direction, in which the carriage 500 performs scanning. For simplification, the print head 501 is assumed to have two ejection ports 502 and 503 arranged at different positions in the main scanning direction. The carriage 500 is attached to a carriage driving belt 504 located so as to extend between a carriage motor pulley 505 and a driven pulley 506. The carriage motor pulley 505 is driven to rotate the driven pulley 506, while moving the carriage driving belt 504 in the main scanning direction. Thus, with the carriage 500 and the print head 501 performing scanning, droplets are ejected to a print medium P through the ejection ports 502 and 503.

Here, if during printing, a vibration created by the driving of the fan is transmitted to the carriage 500, the ejection ports 502 and 503 perform scanning on a track shown in FIG. 9. For simplification, the print medium on the platen does not vibrate but is stationary. The vibration of the print head relative to the print medium and the platen will be considered. In this case, when an area A of the print medium P is to be printed using the ejection ports 502 and 503, the distance between the ejection port and the print medium P varies between when the ejection port 502 reaches a position corresponding to the area A and when the ejection port 503 reaches the position corresponding to the area A. This is because the positions of the ejection ports 502 and 503 in the carriage 500 differ from each other in the main scanning direction, so that when the ejection port reaches the position corresponding to the area A, the phase of the waveform of the track varies between the ejection port 502 and the ejection port 503. In FIG. 10, for a positional relationship between the ejection port and the print medium observed when the print head 501 ejects droplets to the position corresponding to the area A, the distance between the ejection port and the print medium P differs by a distance D. When the difference in distance between the plurality of ejection ports increases, impact accuracy relatively varies between the ejection ports. At the position corresponding to the area A, the distance between the ejection port 502 and the print medium P is longer than that between the ejection port 503 and the print medium P. Thus, in this case, the impact accuracy of droplets from the ejection port 502 is lower than that of droplets from the ejection port 503. This is likely to result in an error when droplets from the ejection port 502 impact the print medium P. Thus, the impact position of the droplets ejected through the ejection port 502 is likely to vary. The impact position of the droplets ejected through the ejection port 502 does not correspond with that of the droplets ejected through the ejection port 503. Thus, when the area A is printed, the resulting image may have a low density.

Furthermore, as shown in FIG. 10, the tracks of the ejection ports 502 and 503 correspond with each other in some areas. Thus, in an area in which the tracks of the ejection ports 502 and 503 correspond with each other, droplets ejected through the ejection ports 502 and 503 impact the same position on the print medium at the same accuracy. As a result, the droplets ejected through the respective ejection ports are likely to correspond with each other. Thus, the insignificant difference in the relative distance from the print medium between the ejection ports 502 and 503 may relatively increase the density of the resulting image. Consequently, the vibration caused by the fan may vary the distance between the ejection port and the print medium observed when the droplets are ejected to the same position through the plurality of ejection ports arranged at the different positions in the main scanning direction. This may vary the density among the resulting images.

In the serial scan ink jet printing apparatus, in which the carriage reciprocates, when the fan continues to be driven at the same number of revolutions, vibration continues at the same frequency. The difference in distance between the ejection ports occurs at the same position in the main scanning direction. Consequently, image density unevenness may occur at particular intervals in the main scanning direction of the print head. Such density unevenness may degrade the quality of images obtained by printing. Multipass printing is sometimes performed in which the same print area is printed by a plurality of carriage scans. As disclosed in Japanese Patent Laid-Open No. 2006-168187, the wind speed of the fan may be reduced for every increase in the number of carriage scans in the same area. However, even the application of such fan control has difficulty avoiding the possible image density unevenness caused by a vibration of a constant frequency resulting from, for example, a variation in motor torque required to rotate the fan.

SUMMARY OF THE INVENTION

Thus, in view of the above-described circumstances, an object of the present invention is to provide a printing apparatus that inhibits possible image density unevenness caused by a variation of a frequency corresponding to the number of revolutions of a fan driving motor.

The first aspect of the present invention is an ink jet printing apparatus comprising: a print head configured to eject ink to a print medium to print the print medium; a carriage configured to allow the print head to perform scanning in a direction crossing a direction in which the print medium is conveyed; a fan configured to be rotationally driven; and a driving section configured to drive the fan, wherein the ink jet printing apparatus performs printing on the basis of a multipass printing method allowing the carriage to perform a plurality of scans on the same print area on the print medium to print an image, and wherein the driving section varies control for rotationally driving the fan in accordance with the scanning action of the carriage, within a range of multipass printing performed on the same predetermined area on the print medium by the print head.

The second aspect of the present invention is a method of controlling an ink jet printing apparatus, the ink jet printing apparatus comprising: a print head configured to eject ink to a print medium to print the print medium; a carriage configured to allow the print head to perform scanning in a direction crossing a direction in which the print medium is conveyed; a fan configured to be rotationally driven; and a driving section configured to drive the fan, wherein the ink jet printing apparatus performs printing on the basis of a multipass printing method allowing the carriage to perform a plurality of scans on the same print area on the print medium to print an image, the method comprising: a step of sensing the scan by the carriage within a range of multipass printing performed on the same predetermined area on the print medium by the print head, and a step of varying control for rotationally driving the fan in accordance with the scanning action of the carriage.

The ink jet printing apparatus and the method of controlling the ink jet printing apparatus are configured so that, in the carriage scanning during multipass printing, the number of revolutions of the fan is varied for each carriage scan. This configuration enables distribution of the adverse effect of the vibration caused by the rotation of the fan during each scan. This inhibits the possible density unevenness of the image.

Further features of the present invention will become apparent from the following description of exemplary embodiments (with reference to the attached drawings).

DESCRIPTION OF THE EMBODIMENTS

Embodiments for carrying out the preset invention will be described below with reference to the attached drawings.

First Embodiment

Figure 1:
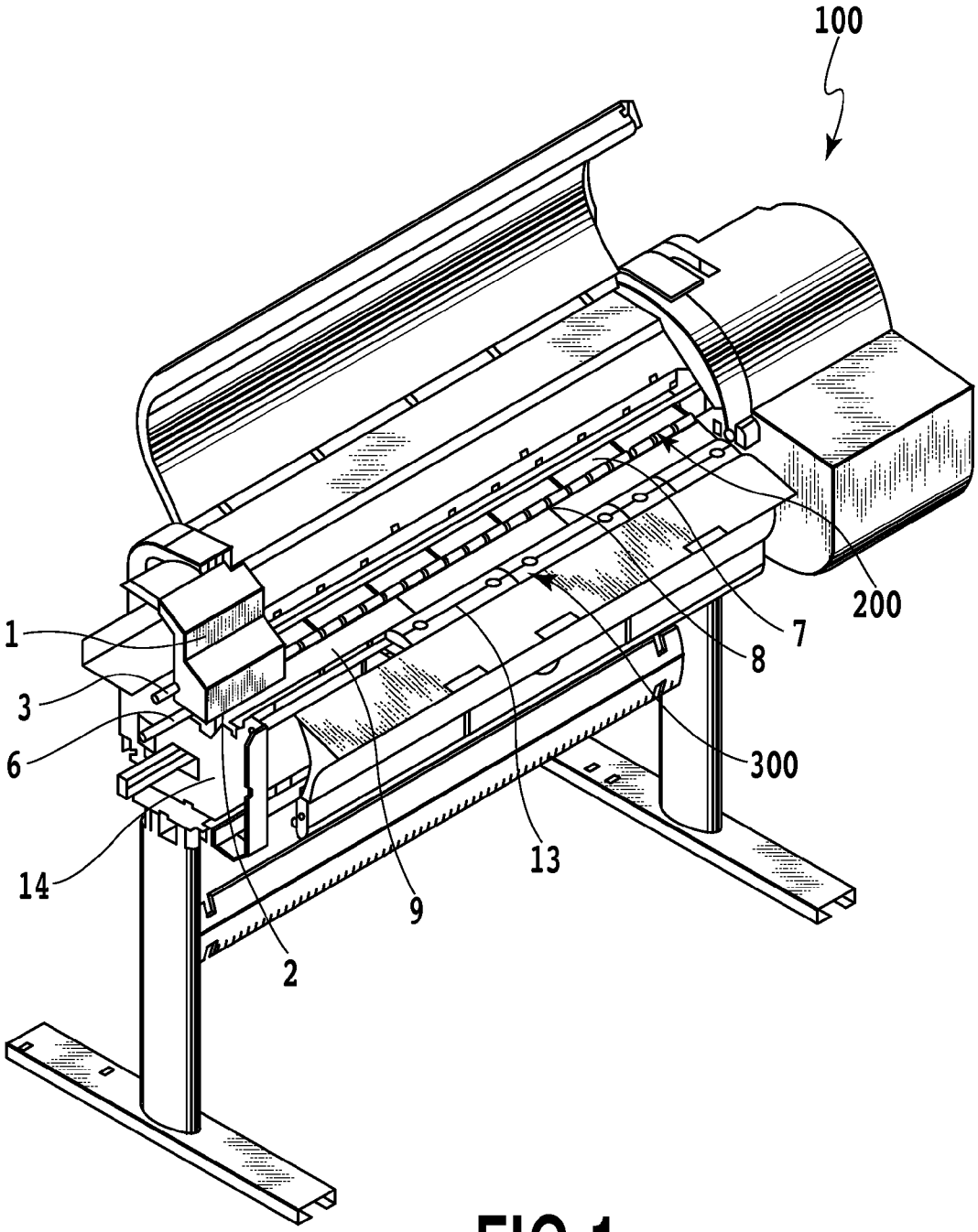
FIG. 1 is a perspective view of an ink jet printing apparatus according to a first embodiment of the present invention with a cover removed therefrom.

The configuration of an ink jet printing apparatus according to a first embodiment of the present invention will be described. FIG. 1 is a perspective view of an ink jet printing apparatus 100 according to the present embodiment.

The ink jet printing apparatus according to the present embodiment is based on the serial scan scheme. A print head 2 is movable in a direction orthogonal to a print medium conveying direction. The ink jet printing apparatus 100 has a carriage 1, a scanning mechanism 200 that reciprocates the carriage 1, a conveying mechanism 300 that conveys a print medium to be printed by the ink jet printing apparatus 100, and a printing apparatus main body.

Figure 2:
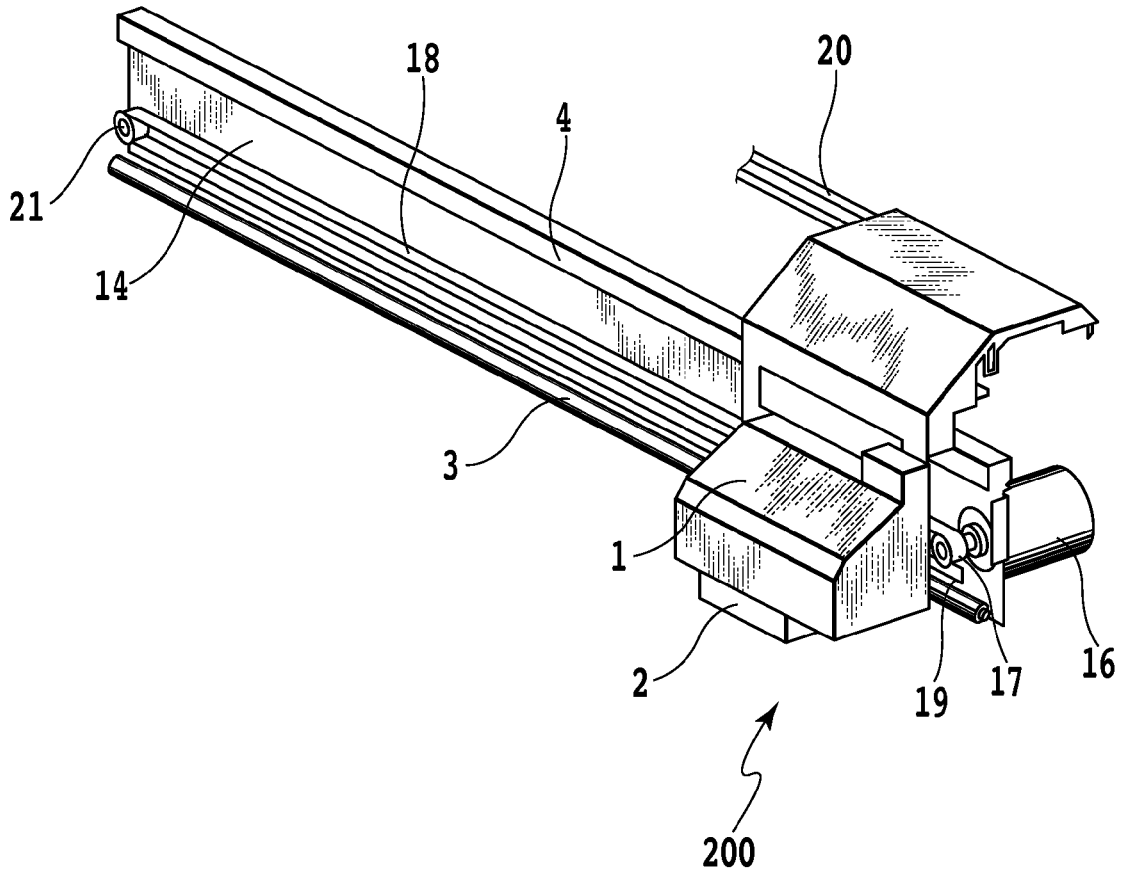
FIG. 2 is an enlarged perspective view of a carriage scanning mechanism in the ink jet printing apparatus according to the present invention.

The carriage 1 includes a print head 2 mounted thereon for scanning the print medium in a direction orthogonal to the direction in which the print medium is conveyed, while ejecting ink to the print medium for printing. The print head 2, mounted on the carriage 1, has a plurality of ejection ports through which ink is ejected as droplets. FIG. 2 shows an enlarged perspective view of the periphery of the carriage 1. During scanning, movement of the carriage 1 is guided by a guide shaft 3 and a guide rail 4. The carriage 1 scans the print medium inside the ink jet printing apparatus 100 along the guide shaft 3 and the guide rail 4 in a direction orthogonal to the print medium conveying direction and parallel to a print surface of the print medium. The carriage 1 has an electrical connection section (not shown in the drawings) that electrically connects the print head 2 to the carriage 1 to transmit print signals and an electrical connection section (not shown in the drawings) that electrically connects the carriage 1 to the printing apparatus main body to transmit print signals.

The ink jet printing apparatus 100 has a flexible substrate 20. The flexible substrate 20 provides the function of the electric connection section to electrically connect the carriage 1 to the printing apparatus main body. An electric instruction value (a signal for ink ejection) from the main body is transmitted to the carriage 1 and the print head 2 through the flexible substrate 20 to print an image. To allow the carriage 1 to perform scanning, a carriage encoder 5 reads a linear scale 19, and a main body control section controls a carriage motor 16 to control the carriage 1.

The scanning mechanism 200 allows the carriage 1 to perform scanning has a carriage driving belt 18, a carriage motor pulley 17, and a driven pulley 21. The carriage driving belt 18 is extended between the carriage motor pulley 17 and the driven pulley 21, arranged at the opposite ends of the printing apparatus main body. To make the carriage 1 movable, the carriage driving belt 18 is fixed to the carriage 1 so as not to move relative to the carriage 1. The driving force of the carriage motor 16 is transmitted to the carriage 1 via the carriage driving belt 18 to allow the carriage 1 to perform scanning.

Figure 3:
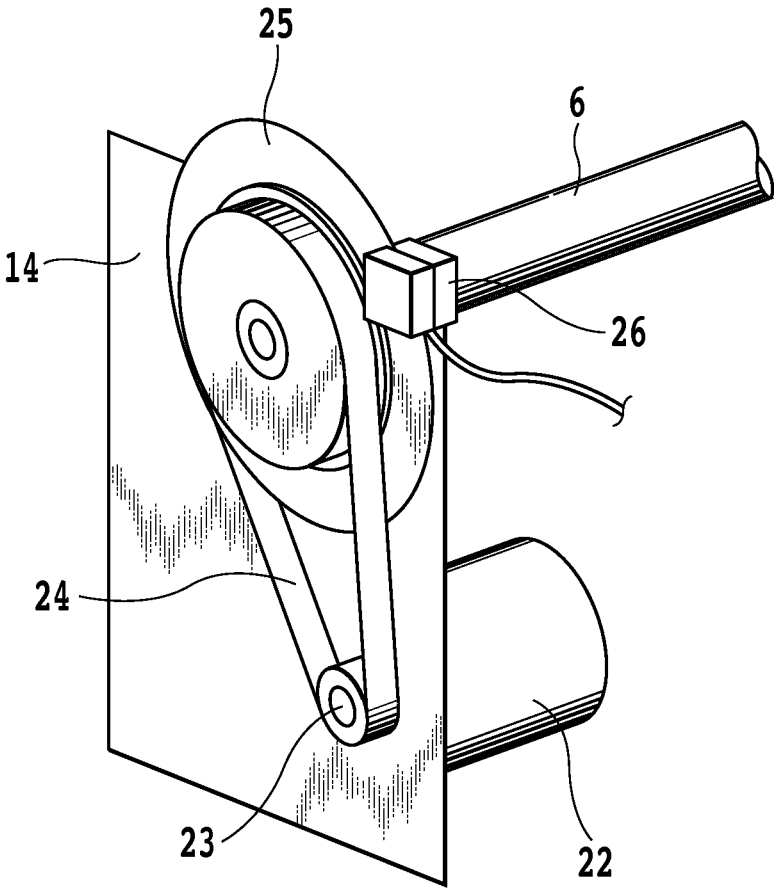
FIG. 3 is an enlarged perspective view of a peripheral portion of a conveying motor in the ink jet printing apparatus according to the present invention.

The conveying mechanism 300 conveying the print medium has a conveying roller 6, a driven roller 8, a conveying motor 22, a conveying rotary scale 25, and a conveying encoder 26. The conveying mechanism 300 further has a conveying motor pulley 23 and a conveying belt 24. The conveying roller 6 is driven by a conveying motor 22 to convey the print medium. FIG. 3 shows an enlarged perspective view of a peripheral portion of the conveying motor 22. The conveying rotary scale 25 is fixed so as not to move relative to the conveying roller 6. The conveying rotary scale 25 rotates in conjunction with the conveying roller 6. While the conveying roller 6 is conveying the print medium, the conveying encoder 26 uses the conveying rotary scale 25 to read the position of the print medium. The main body control section then controls the conveying motor 22.

The print medium driven by the conveying roller 6 is fed to a nip position along a sheet feeding guide 12. When conveyed to the nip position, the print medium is sandwiched between the conveying roller 6 and the driven roller. At this time, the driven roller 8 is elastically supported on a chassis 14 so as to exert a nip pressure on the conveying roller 6. The driven roller 8 is attached to a driven roller table 7. The print medium is conveyed, by the conveying roller 6, onto a platen 9 corresponding to a print position. Subsequently, the print medium is discharged toward a sheet discharging guide 13.

Figure 4:
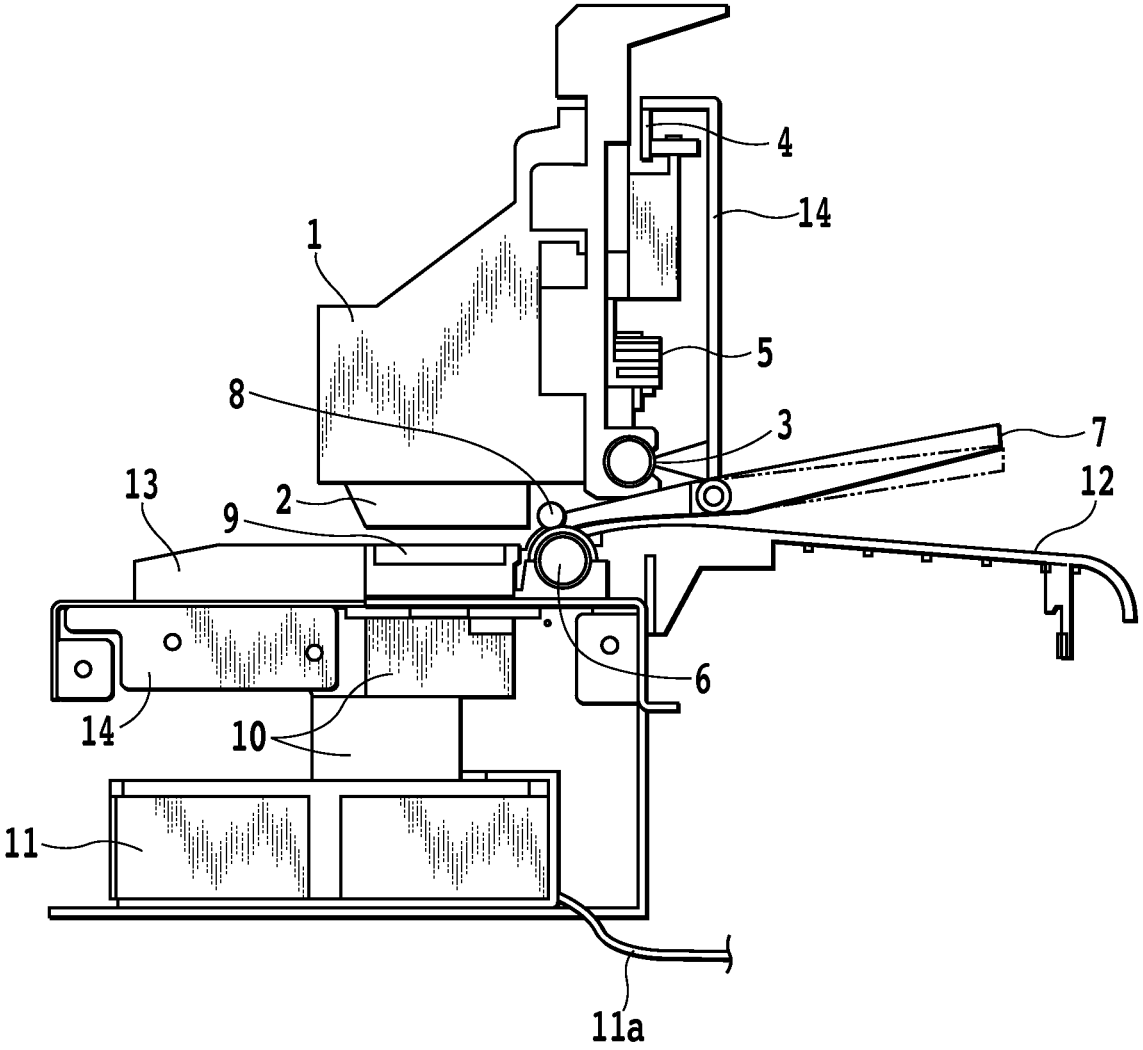
FIG. 4 is a sectional view of the ink jet printing apparatus according to the present invention.

In the ink jet printing apparatus 100 according to the present embodiment, a suction port is formed in the platen 9. FIG. 4 shows a sectional view of the ink jet printing apparatus 100 as viewed from a side thereof. A platen suction fan 11 is mounted in the ink jet printing apparatus 100 as a fan configured to be rotationally driven. The suction port in the platen 9 is coupled to the platen suction fan 11 via a platen suction duct 10. Thus, when the platen suction fan 11 is driven, a negative pressure is formed in the suction duct 10 to enable air to be sucked through the suction port. In this manner, the platen suction fan 11 and the suction duct 10 are arranged to generate a negative pressure on a conveying path for the print medium to allow the print medium to be sucked onto the conveying path. A platen suction fan electric harness 11*a* connected to the platen suction fan 11 is joined to the main body control section to control the driving speed of the platen suction fan 11, that is, the number of revolutions of the fan. In the present embodiment, the platen suction fan 11 is driven to suck air through the suction port to tightly contact the print medium on the platen 9 with a surface of the platen 9.

The guide shaft 3, the guide rail 4, the conveying roller 6, the platen suction fan 11, and the like are fixed to the chassis 14, which is a part of the printing apparatus main body, to constitute the above-described mechanism.

When the platen suction fan 11 is driven to suck the print medium onto the platen, vibration may occur due to eccentricity of a blade portion or a possible cogging torque on a fan motor. The frequency of the vibration depends on the shape of the fan or the shape of the fan motor or the number of revolutions of the fan motor. The vibration caused by the platen suction fan 11 is transmitted to the carriage 1 or the platen 9 via the chassis 14 or the like. A vibration transmission path from the platen suction fan 11 to the carriage 1 differs from that from the platen suction fan 11 to the platen 9. Thus, the amplitude and phase of the vibration caused by the driving of the fan varies between the carriage 1 and the platen 9. The print head 2, mounted on the carriage 1, vibrates at an amplitude and a phase different from that at which the print medium sucked and supported on the platen 9 vibrates.

In the present embodiment, in the ink jet printing apparatus 100, the platen suction fan 11 is drivingly controlled to vary the number of revolutions thereof for every predetermined amount of scanning by the print head 2. Table 1 shown below shows a process of variation in the driving duty of a motor for the platen suction fan 11, mounted in the ink jet printing apparatus according to the present embodiment.

Figure 5:
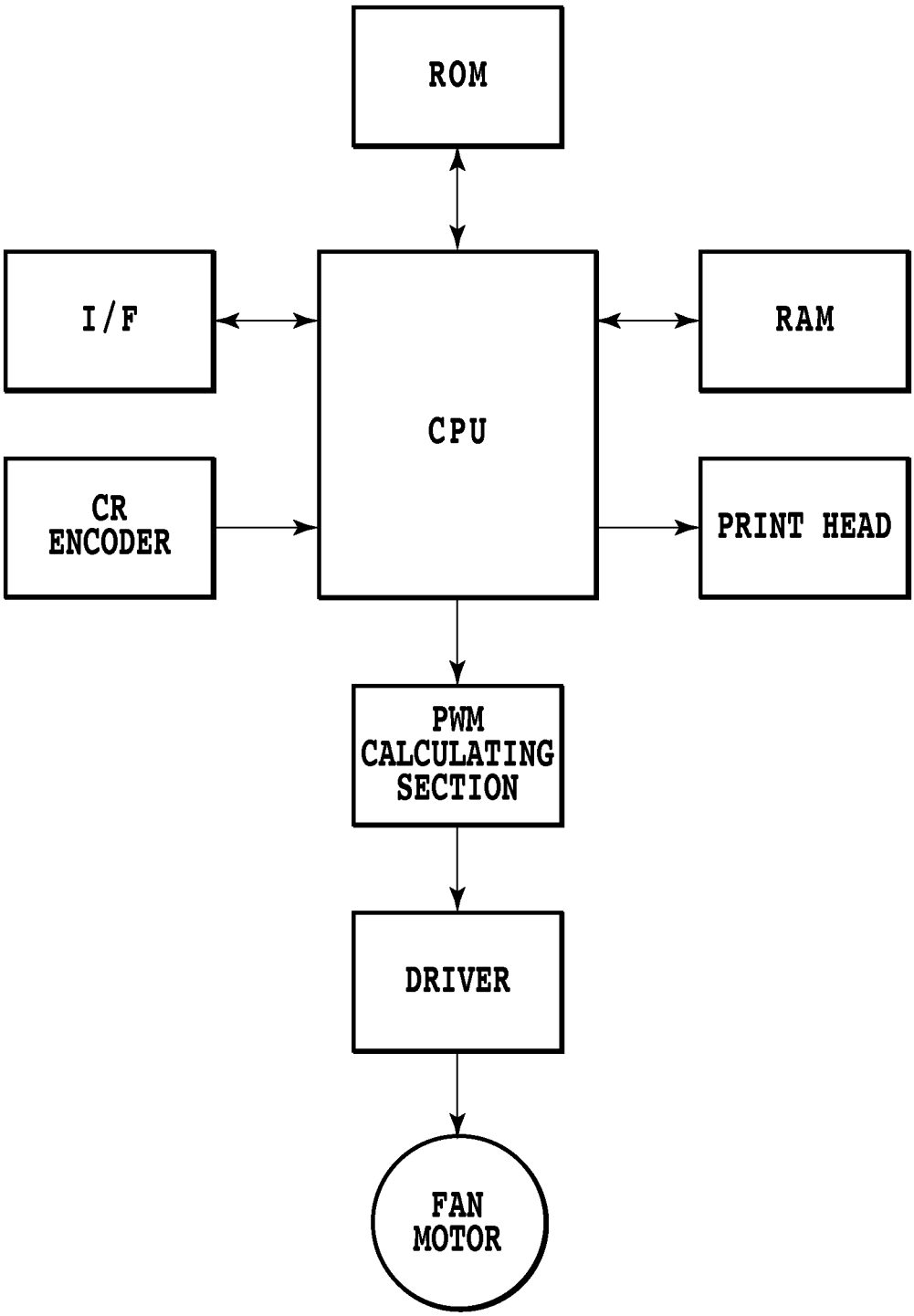
FIG. 5 is a block diagram relating to fan driving in the printing apparatus according to the present invention.

The driving duty indicates the ratio of the load imposed on the driving motor for the platen suction fan 11 when the fan 11 is driven to the load imposed on the driving motor in an operating condition in which the voltage is set to the maximum value to drive the fan 11 at the maximum number of revolutions. The load in which the voltage is set to the maximum value is defined as 100%. Specifically, the ratio of the load imposed on the motor when the fan is driven is indicated by the ratio of the voltage applied to a power source for the driving source in order to operate the fan (this will be described below in detail). Consequently, the driving duty varies depending on the value of the driving voltage for the driving motor used to drive the fan. In the present embodiment, the number of revolutions of the fan offered when the voltage is set to the maximum value is set to 110 (Hz). The maximum number of revolutions of the fan depends on the type or use form of the printing apparatus and is not limited to this value. FIG. 5 is a block diagram useful for controlling the driving motor for the fan in the ink jet printing apparatus according to the present invention. An I/F performs communication with a host computer and the like. The carriage encoder 5 detects the position and scanning speed of the carriage 1. CPU determines whether the carriage has performed forward or backward scanning, on the basis of the position and speed detected by the carriage encoder. Here, processing of the determination of the scanning by the carriage is performed in the range of the multipass printing. For example, if printing of a predetermined area is completed by six passes, the determination is performed in the range of the six passes. Various programs required to control CPU and driving conditions are stored in ROM or RAM. CPU also controls printing performed by the print head, or the like. If the carriage has completed forward or backward scanning, CPU changes the driving duty of the fan motor. The driving duty of the fan motor corresponds to a value calculated by a PWM calculating section for determining a pulse voltage width of the motor. The pulse voltage width is controlled to adjust the voltage applied to the fan motor. A driver shown in FIG. 5 is a driver circuit that drives the fan motor on the basis of the results of calculations by the PWM calculating section. A change in driving duty of the fan changes the voltage applied to the fan motor and thus the number of revolutions of the fan. For example, a decrease in driving duty reduces the number of revolutions of the fan.

Figure 6:
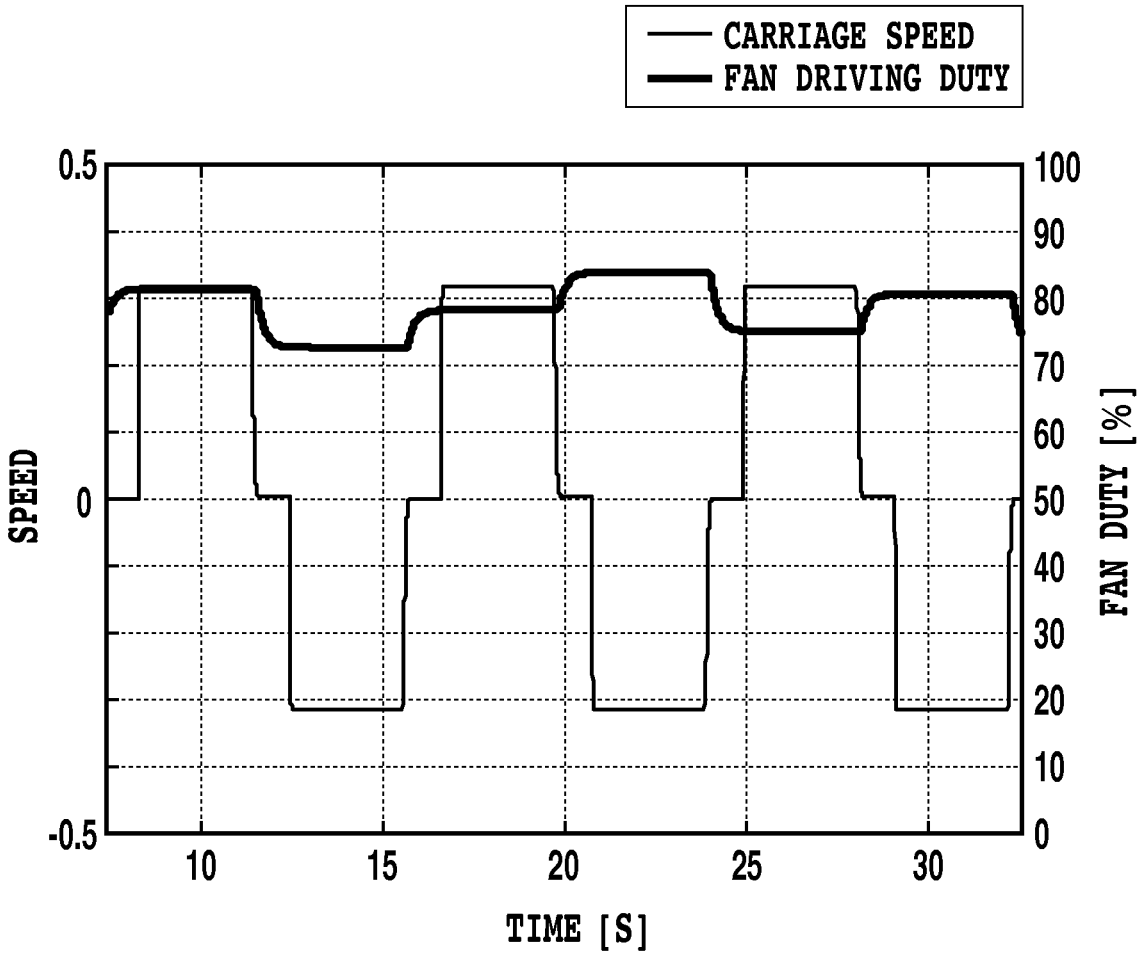
FIG. 6 is a graph showing the relationship between the speed of the carriage and the driving duty of a platen suction fan according to the present invention with respect to the elapse of time which relationship is observed when the platen suction fan is driven.

FIG. 6 shows the driving duty of the platen suction fan 11 and the moving speed of the carriage during scanning, according to the present embodiment. In the present embodiment, the driving duty of the fan is set as a parameter determined in association with the number of revolutions of the platen suction fan 11. The driving duty is set to vary for every predetermined amount of scanning by the print head 2. In particular, in the present embodiment, the driving duty is set to vary every scan. The number of revolutions of the platen suction fan 11 varies depending on the driving duty. In the ink jet printing apparatus 100 according to the present embodiment, the carriage 1 is reciprocatingly driven on the same area of the print medium plural times to form an image. That is, printing is performed on the basis of what is called the multipass printing method. For example, in the present embodiment, the number of multipass printing operations is six (these operations are hereinafter referred to as six passes). One area is printed by six scans of the carriage 1 to complete the printing in the area. In the present embodiment, the number of revolutions of the platen suction fan 11 varies for every scan performed by carriage 1 with the print head 2 mounted thereon. In Table 1, an upper stage shows the number of passes in the multipass printing. A lower stage shows the driving duty.

TABLE 1

| First pass | Second pass | Third pass | Fourth pass | Fifth pass | Sixth pass |
|---|---|---|---|---|---|
| 82% | 73% | 78% | 84% | 75% | 80% |

For the first pass, the second pass, . . . and the sixth pass, a driving instruction value for the driving duty of the platen suction fan 11 varies for every scan. Consequently, for the first pass, the second pass, . . . and the sixth pass, the number of revolutions of the platen suction fan 11 varies for every scan. Here, one scan refers to movement of the print head during a half of one reciprocation for the scan. Thus, for each print area, the print head 1 passes over and prints the print area only once during one scan. In this manner, in the ink jet printing apparatus 100 according to the present embodiment, the driving duty of the fan is varied every time the carriage performs a scan to allow the print head 2 to carry out the multipass printing in the process of the scan of the print head. Specifically, the present embodiment has a control step of driving the platen suction fan 11 so as to vary the number of revolutions of the platen suction fan 11 during the scan performed by the carriage for the multipass printing (in the present embodiment, six passes). Since the platen suction fan 11 is drivingly controlled so as to vary the number of revolutions of the platen suction fan 11 as described above, the frequency of vibration of the carriage 1 or the platen 9 caused by the driving of the platen suction fan 11 varies among the first pass, the second pass, . . . , and the sixth pass. Consequently, a difference in ink density and the position of the difference in the print medium vary among the first pass, the second pass, . . . , and the sixth pass. In the present embodiment, the driving duty, which is a parameter for the number of revolutions of the platen suction fan 11, is not regular but is set to be irregular as shown in Table 1. Thus, when an image is formed by six passes, a difference in the impact accuracy of ink from the plurality of ejection ports of the same print head is prevented from occurring at particular positions during the first pass, the second pass, . . . , and the sixth pass. Therefore, unevenness of the ink density is not regular but is distributed, in the print medium. This enables a reduction in possible density unevenness in the carriage scanning direction, which is associated with the number of revolutions of the platen suction fan 11. The reduction in possible density unevenness in the printed image improves the quality of the resulting image.

Second Embodiment

Figure 7:
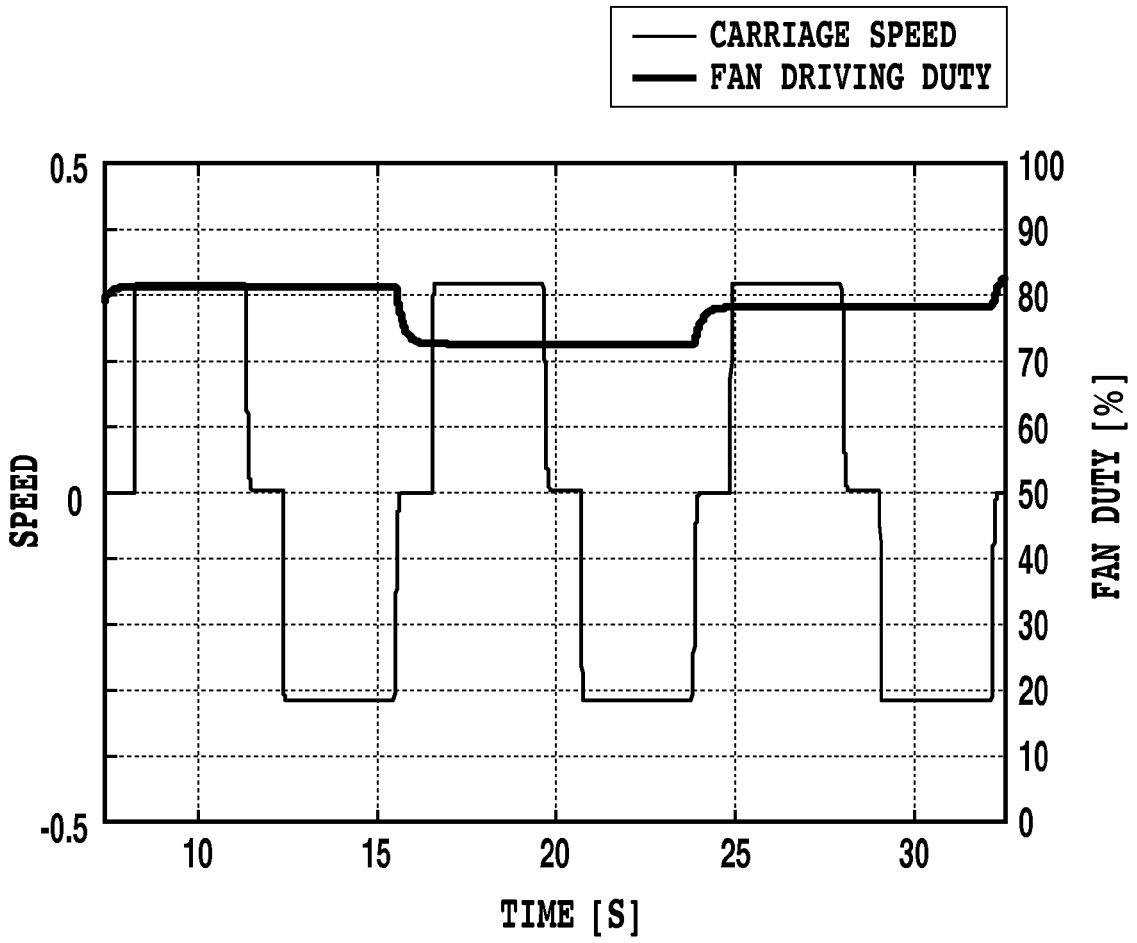
FIG. 7 is a graph showing the relationship between the speed of the carriage and the driving duty of the platen suction fan with respect to the elapse of time which relationship is observed when the platen suction fan is driven, in an ink jet printing apparatus according to a second embodiment of the present invention.

Now, a second embodiment of the ink jet printing apparatus according to the present invention will be described with reference to FIG. 7. Components of the ink jet printing apparatus which can be configured as described above in the first embodiment will not be described. Only differences from the first embodiment will be described. FIG. 7 shows a variation in the number of revolutions of the platen suction fan 11 of the present embodiment during driving. In the present embodiment, the platen suction fan 11 is controlled so as to vary the number of revolutions of the platen suction fan 11 for each of a plurality of scans by the print head 2 within the range of the multipass printing. For example, when the carriage 1 performs printing through six passes as in the case of the present embodiment, the control is performed so as to vary the number of revolutions of the fan for every two scans.

TABLE 2

| First pass | Second pass | Third pass | Fourth pass | Fifth pass | Sixth pass |
|---|---|---|---|---|---|
| 82% | 82% | 73% | 73% | 78% | 78% |

When an image is formed by six passes, the amount of deviation of the impact position of ink varies between the first and second passes and the third and fourth passes and the fifth and sixth passes. Thus, the impact deviation is not regular but is distributed. This reduces possible density unevenness associated with the number of revolutions of the platen suction fan 11.

Third Embodiment

Figure 8:
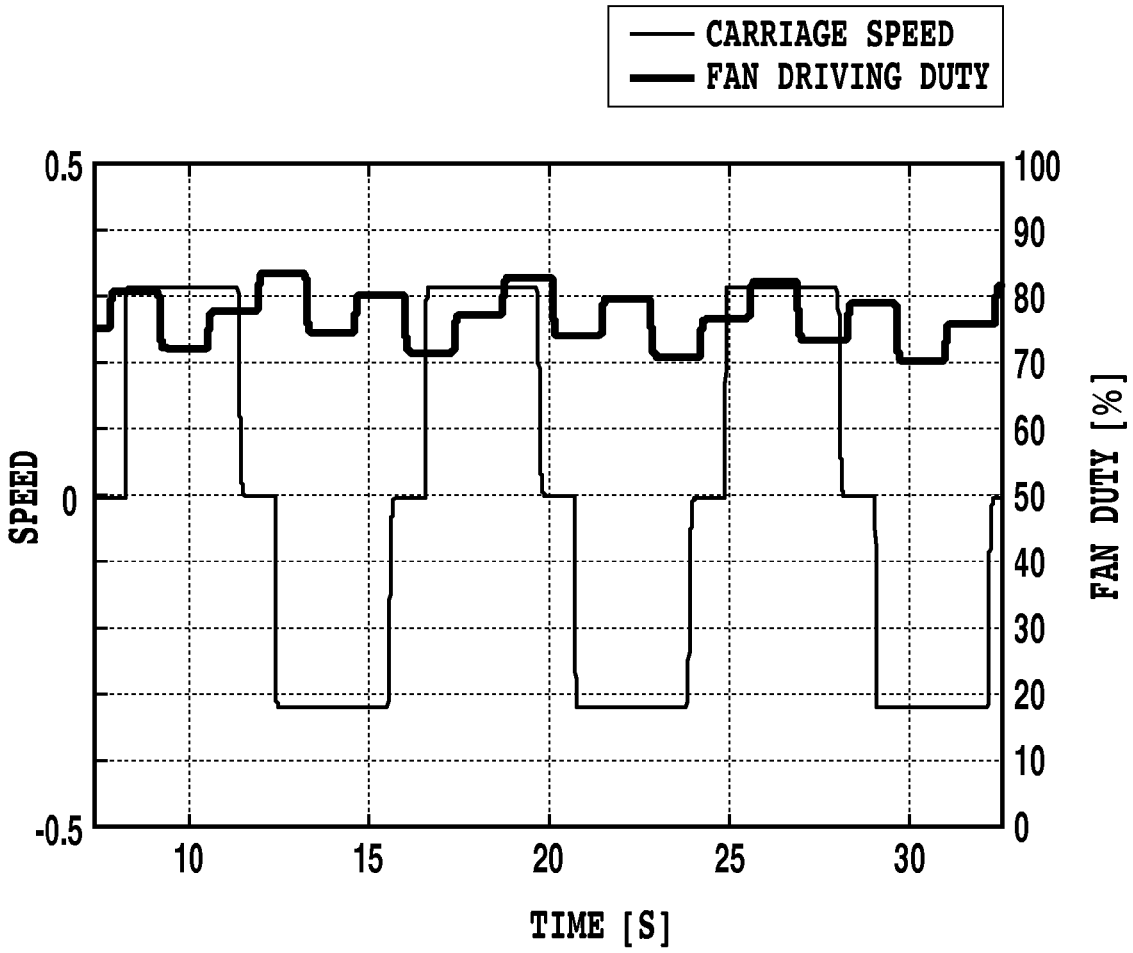
FIG. 8 is a graph showing the relationship between the speed of the carriage and the driving duty of the platen suction fan with respect to the elapse of time which relationship is observed when the platen suction fan is driven, in an ink jet printing apparatus according to a third embodiment of the present invention.
Figure 9:
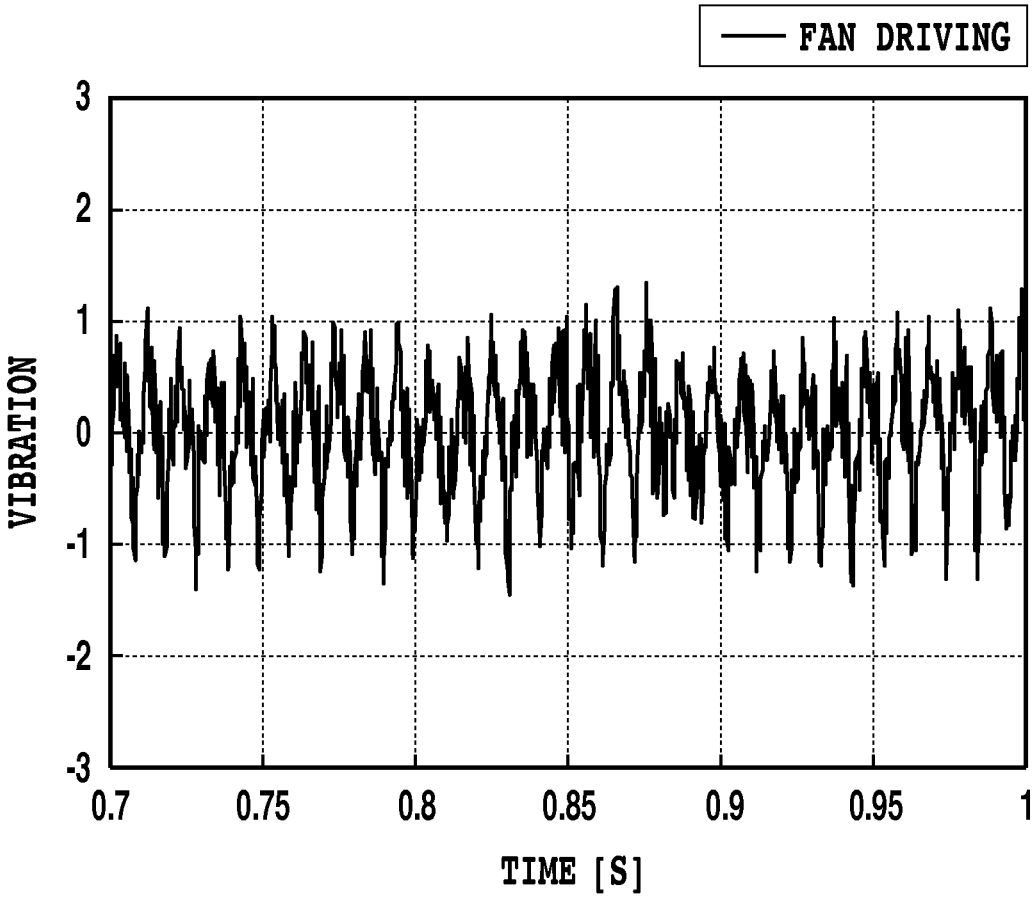
FIG. 9 is a graph showing vibration caused by rotation of a platen suction fan in a conventional ink jet printing apparatus when the platen suction fan is driven.
Figure 10:
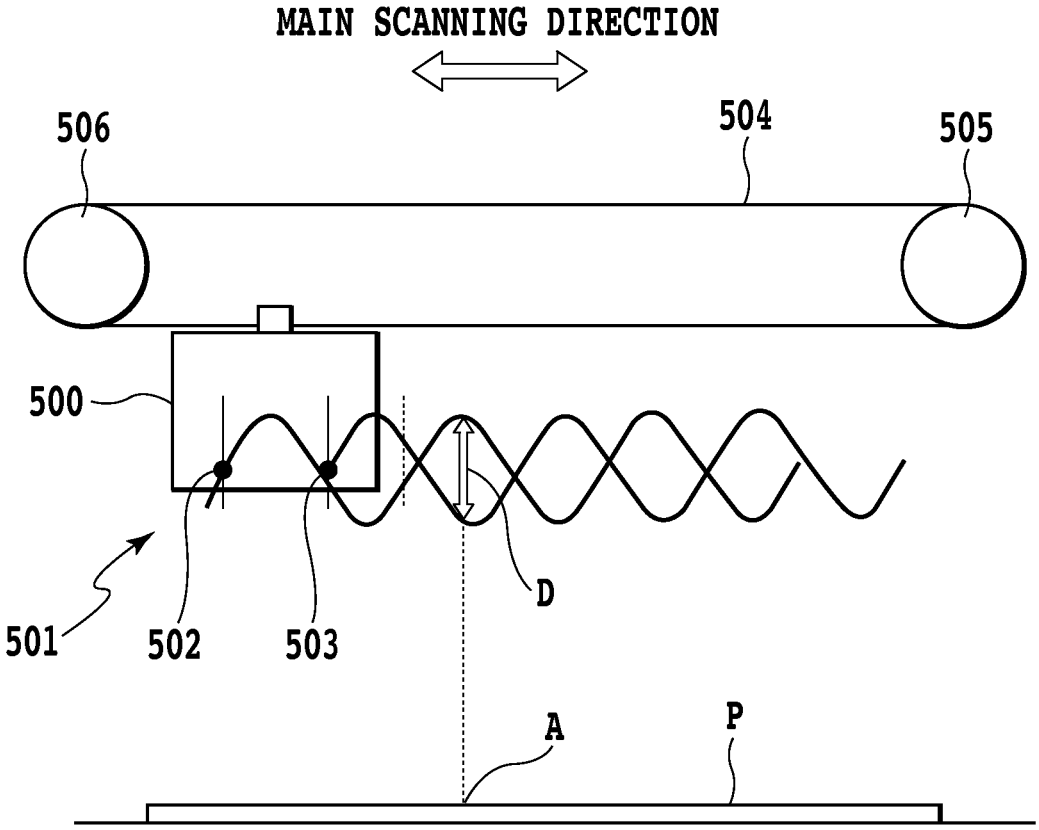
FIG. 10 is a diagram illustrating the relationship between an ejection port and a print medium in the conventional ink jet printing apparatus.

Now, a third embodiment of the ink jet printing apparatus according to the present invention will be described with reference to FIG. 8. FIG. 8 shows a method of drivingly controlling the platen suction fan 11. In the present embodiment, for the multipass printing with six passes, the number of revolutions of the platen suction fan 11 is varied plural times during one scan of the print head 2. Thus, during one scan of the carriage 1, the number of revolutions of the platen suction fan 11 is controlled such that the driving speed of the platen suction fan 11 is varied a plurality of times by a driving section of the fan. In the present embodiment, as shown in Table 3, shown below, the number of revolutions of the fan is controlled so as to vary the driving speed in three stages during one scan of the carriage 1.

TABLE 3

| First pass | | | Second pass | | |
|---|---|---|---|---|---|
| First change | Second change | Third change | First change | Second change | Third change |
| 82% | 73% | 78% | 84% | 75% | 82% |
| **Third pass** | | | **Fourth pass** | | |
| First change | Second change | Third change | First change | Second change | Third change |
| 72% | 77% | 84% | 75% | 80% | 71% |
| **Fifth pass** | | | **Sixth pass** | | |
| First change | Second change | Third change | First change | Second change | Third change |
| 77% | 82% | 74% | 80% | 71% | 76% |

Other Embodiments

In the first to third embodiments, the fan is mounted in order to fixedly suck the print medium onto the print position in the ink jet printing apparatus 100. However, the application of the fan is not limited to this aspect. For example, the fan may be mounted in the ink jet printing apparatus so as to generate an air stream in the space between the print head and the platen located at the print position. When the fan is mounted in the ink jet printing apparatus so as to generate an air stream in the space between the print head and the platen, the air stream generated enables movement or collection of ink as a liquid present in the space between the print head 2 and the print medium. That is, in the present embodiment, the air stream generated by the driving of the fan allows ink mist or satellites suspended in the space to be carried to an area where the ink mist or satellites are prevented from affecting printing. When a collecting section is mounted downstream of the air stream in the space, the ink mist or satellites carried by the air stream can be collected. Thus, the ink mist or satellites blown by the air stream can be inhibited from affecting the surrounding environment.

Alternatively, the fan may be mounted in the ink jet printing apparatus in order to cool the ink jet printing apparatus or to dry the ink on the print medium, or may be mounted for any other application.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-294390, filed Nov. 13, 2007 and 2008-257507, filed Oct. 2, 2008, which are hereby incorporated by reference herein in their entirety.

What is claimed is:

1. An ink jet printing apparatus comprising:

a print head configured to eject ink to a print medium;

a carriage configured to allow the print head to perform scanning guided by a guide shaft in a direction crossing a direction in which the print medium is conveyed;

a platen having a suction port in which a negative pressure is supplied to suck the print medium onto the platen;

a fan configured to generate the negative pressure supplied to the suction port;

a duct connected to the suction port for supplying the negative pressure generated by the fan; and a chassis on which the platen and the fan are fixed, wherein vibrations caused by the fan are transmitted to the platen via the chassis and the duct and are transmitted to the carriage via the chassis and the guide shaft, wherein the ink jet printing apparatus being controlled to perform multipass printing by reciprocating the carriage to perform N-number of repeated scans on an area of the print medium to form an image with ink ejected from the print head, and the apparatus further comprising a controller configured to set a rotational driving of the fan at a first state in a first scan and at a second state, which is different from the first state, in a second scan, and wherein the first and the second scans are included in the N-number of repeated scans, whereby possible density unevenness of the printed image which is caused by the vibrations of the fan is reduced.

2. The ink jet printing apparatus according to claim 1, wherein the controller controls the rotational driving of the fan by varying a voltage of a driving source.

3. The ink jet printing apparatus according to claim 1, wherein the controller controls the rotational driving of the fan by varying a number of revolutions of the fan.

4. The ink jet printing apparatus according to claim 3, wherein the controller controls the rotational driving of the fan by irregularly varying the number of revolutions of the fan.

5. The ink jet printing apparatus according to claim 1, wherein the controller varies the rotational driving of the fan for each scan by the carriage included in the N-number of repeated scans.

6. The ink jet printing apparatus according to claim 1, wherein the controller varies the rotational driving of the fan for each of a plurality of scans by the carriage included in the N-number of repeated scans.

7. The ink jet printing apparatus according to claim 5, wherein the controller further varies the rotational driving of the fan a plurality of times during each scan.

8. The ink jet printing apparatus according to claim 1, wherein the suction port is configured to collect ink mist around the print head when the suction port is not covered by the print medium.

9. The ink jet printing apparatus according to claim 1, wherein the controller varies the number of revolutions of the fan by varying a parameter corresponding to the number of revolutions of the fan in accordance with the scanning action of the carriage.

* * * * *